US010265241B1

(12) United States Patent
Paul

(10) Patent No.: US 10,265,241 B1
(45) **Date of Patent: *Apr. 23, 2019**

(54) INTEGRAL GUM SOOTHER

(71) Applicant: Delores Ann Paul, Odessa, TX (US)

(72) Inventor: Delores Ann Paul, Odessa, TX (US)

( * ) Notice: Subject to any disclaimer, the term of this patent is extended or adjusted under 35 U.S.C. 154(b) by 240 days.

This patent is subject to a terminal disclaimer.

(21) Appl. No.: 15/387,480

(22) Filed: Dec. 21, 2016

Related U.S. Application Data

(63) Continuation-in-part of application No. 15/197,512, filed on Jun. 29, 2016, now Pat. No. 9,597,256.

(51) Int. Cl.
*A61J 17/00* (2006.01)
*A61H 23/02* (2006.01)

(52) U.S. Cl.
CPC . *A61H 23/0263* (2013.01); *A61H 2201/0153* (2013.01); *A61H 2201/1215* (2013.01)

(58) Field of Classification Search
CPC ..... A61H 13/00; A61H 23/00; A61H 23/02; A61H 23/0254; A61H 23/0263; A61H 2201/00; A61H 2201/0157; A61H 2201/169; A61H 2201/1692; A61H 2201/1695; A61H 2201/1215; A61H 2201/0153
See application file for complete search history.

(56) References Cited

U.S. PATENT DOCUMENTS 3,669,117 A * 6/1972 Herbst ..... A61J 17/02 606/235
4,716,902 A 1/1988 Swartz
5,160,344 A * 11/1992 Werton ..... A61J 17/02 606/234
5,292,335 A 3/1994 Shin
5,606,871 A * 3/1997 Hansen ..... F25D 3/08 606/235
5,649,964 A 7/1997 Berman et al.
5,693,073 A 12/1997 Glick et al.
5,711,759 A 1/1998 Smith
5,902,322 A 5/1999 Scagliotti
6,053,881 A 4/2000 Boodramsingh
6,264,678 B1 7/2001 Landers
6,468,294 B2 10/2002 Griffith
6,591,140 B2 7/2003 Strome
7,211,102 B2 5/2007 DeSousa et al.
D593,203 S 5/2009 Kliegman
8,182,510 B2 * 5/2012 Brabant ..... A61J 17/02 606/235
9,597,256 B1 * 3/2017 Paul ..... A61H 23/0263
9,855,187 B2 * 1/2018 Martin ..... A61H 23/00
(Continued)

*Primary Examiner* — Steven O Douglas

(74) *Attorney, Agent, or Firm* — Rao DeBoer Osterrieder, PLLC; Dileep P. Rao

(57) ABSTRACT

A gum soother with a bristle-less wand, an internal vibrating device, a power supply connected to the internal vibrating device, an on/off switch for activating the internal vibrating device, and a mouth guard connected to the bristle-less wand. The mouth guard can extend at a first angle from the bristle-less wand and a flex neck connected to the bristle-less wand can extend at a second angle from the mouth guard. A hollow membrane-free dual chew tip can be connected to the flex neck, wherein the hollow membrane-free dual chew tip can be configured to sustain a reduced temperature from room temperature of at least 20 degrees Fahrenheit, if needed.

14 Claims, 3 Drawing Sheets

(56) References Cited

U.S. PATENT DOCUMENTS

| | | | | |
|---|---|---|---|---|
| 2003/0171647 | A1* | 9/2003 | Garland | A61H 19/44<br>600/38 |
| 2007/0244416 | A1* | 10/2007 | Sobin | A61H 19/44<br>601/46 |
| 2012/0179077 | A1* | 7/2012 | Tuck | A61H 19/44<br>601/46 |
| 2013/0178769 | A1 | 7/2013 | Schmidt | |

* cited by examiner

INTEGRAL GUM SOOTHER

CROSS REFERENCE TO RELATED APPLICATIONS

The present application is a Continuation in Part of co-pending U.S. patent application Ser. No. 15/197,512 filed on Jun. 29, 2016, entitled "INTEGRAL ONE PIECE GUM SOOTHER." This application is incorporated in its entirety.

FIELD

The present embodiments generally relate to an integral gum soother.

BACKGROUND

A need exists for a device that individuals can use to massage gums without fear of choking.

A further need exists for children to have a device that helps improve dental hygiene at an early age, as well as accelerate teeth cutting.

The present embodiments meet these needs.

BRIEF DESCRIPTION OF THE DRAWINGS

The detailed description will be better understood in conjunction with the accompanying drawings as follows.

Figure 1:
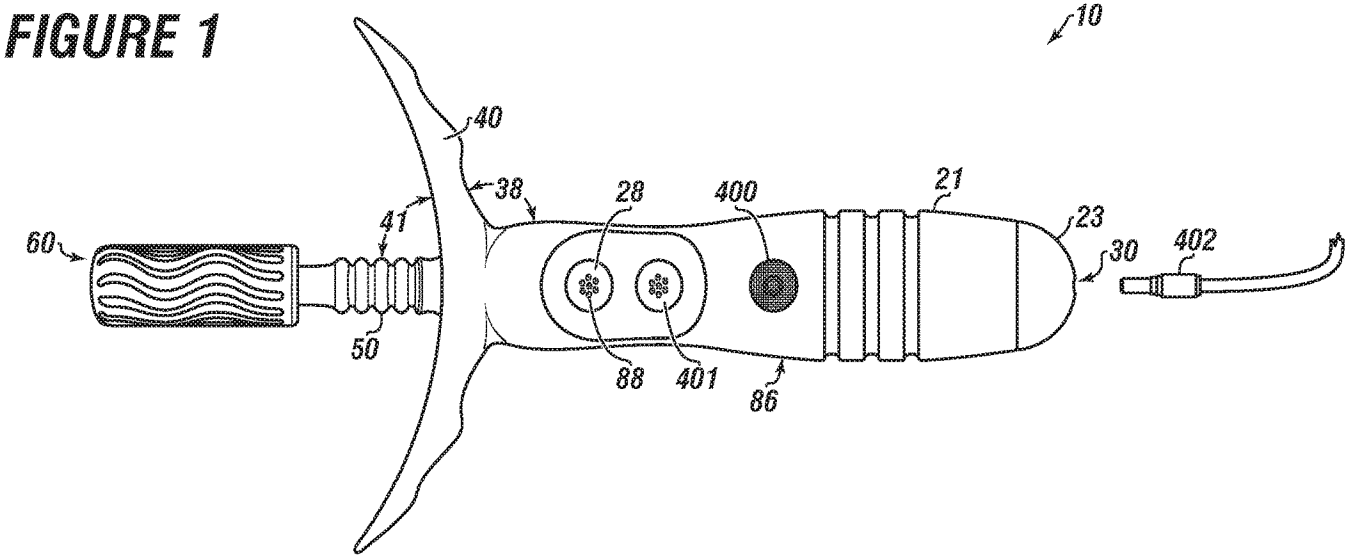
FIG. 1 depicts a side view of an integral gum soother according one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a gum soother.

The first embodiment of the integral gum soother can have a speaker, a programmable logic circuit, which can be connected to the speaker, and a USB port.

In this embodiments, the integral gum soother with a bristle-less wand having a motor, a power supply connected to the motor, a programmable logic circuit interior to a bristle-less wand for receiving and storing for playback an audio message, and a USB port at an end of the bristle-less wand for receiving an audio message from a source external to the integral gum soother.

In embodiments, the USB port can convey the audio message to the programmable logic circuit, and a speaker internal to the bristle-less wand can be connected to the programmable logic circuit for playing back the audio message.

In this embodiment, the bristle-less wand can have an on/off recording switch connected to the programmable logic circuit enabling actuation and stopping of playback of the audio message and an on/off switch connected between a power supply and a motor for activating the motor with an internal vibrating device connected to the motor.

In embodiments, a mouth guard can be connected to the bristle-less wand extending at a first angle, which can be from 40 degrees to 120 degrees from the bristle-less wand.

A flex neck can connect longitudinally to the bristle-less wand extending at a second angle, which can be from 40 degrees to 120 degrees from the mouth guard.

A hollow membrane-free dual chew tip can be integrally connected to the flex neck, wherein the hollow membrane-free dual chew tip can be configured to contact and massage the gums and sustain a reduced temperature from room temperature to at least 20 degrees Fahrenheit, if needed, and further wherein the hollow membrane-free dual chew tip can contain a rotating vibrating arm.

The second embodiment of the integral gum soother can have the same components as the first embodiment; however, the chew tip can have a first wall, a second wall parallel to and in a spaced apart relationship from the first wall forming a channel, and a temperature control material 109 located in the channel between the first and second walls for holding a different temperature than the walls, such as a cooler temperature than the walls or a higher temperature than the walls.

In embodiments, the integral gum soother can have a temperature control material, such as a gel or beads.

In a third embodiment of the gum soother, the integral one gum soother can have a bristle-less wand containing a motor, a power supply connected to the motor, an on/off switch connected between the power supply and the motor for activating the motor, an internal vibrating device connected to the motor, a mouth guard connected to the bristle-less wand extending at a first angle, such as from 40 degrees to 120 degrees from the bristle-less wand, a flex neck connected longitudinally to the bristle-less wand extending at a second angle, such as from 40 degrees to 120 degrees from the mouth guard, and a removable hollow membrane-free dual chew tip threadably engaging the bristle-less wand using first threads installed on the bristle-less wand and second threads installed on the flexible neck, wherein the hollow membrane-free dual chew tip is configured to contact and massage the gums and sustain a reduced temperature from room temperature to at least 20 degrees Fahrenheit if needed, and further wherein the hollow membrane-free dual chew tip contains a rotating vibrating arm.

In embodiments, the gum soother can be a one piece integral gum soother. In other embodiments, the gum soother can have a removable hollow membrane-free chew tip.

In embodiments, the hollow membrane-free dual chew tip or the removable hollow membrane-free dual chew tip can be connected to the flex neck, which can partially contain the vibrating device.

In embodiments, the hollow membrane-free dual chew tip can be configured to sustain a reduced temperature from room temperature to at least 20 degrees Fahrenheit, if needed.

The embodiments work effectively and instantly to release pressure in infant's ears during flying or travel by enabling them to chew safely on a vibrating device that can also soothe them.

The embodiments lessen teething time for young children and encourage teeth to come in sooner while reducing pain to the young child or infant of 4 months old.

The embodiment can freeze to a semi-solid with no condensation to more quickly reduce swelling or inflammation of gums while vibrating.

The embodiments encourage an infant or young child to get used to placing an object, similar to a toothbrush, into the mouth early in life to create good oral hygiene habits.

The embodiments can be used on animals, such as dogs, to create good oral hygiene and can help reduce pain and swelling with teeth and gum issues.

The embodiments have a mouth guard to prevent chocking and death in infants and young children of up to 6 years.

Turning now to the Figures, FIG. 1 depicts a side view of an integral gum soother according one or more embodiments.

The integral gum soother 10 can have a bristle-less wand 21.

The bristle-less wand 21 can have an on/off switch 28 with a switch locator 88 so that a user can easily locate the on/off switch 28. The switch locator 88 can be a series of bumps or depressions on the on/off switch 28. The on/off switch can be a pressure actuated switch.

An ergonomic grip 86 can be formed on an outer surface of the bristle-less wand 21, allowing a user to obtain a sure and comfortable grip on the bristle-less wand 21. In embodiments, the ergonomic grip 86 can be tapered. In other embodiments, the ergonomic grip 86 can have finger depressions for each finger of a child holding the bristle-less wand 21. Four finger depressions can be formed, each having a depth of about 0.3 inches to 0.5 inches.

A removable detachable cap 23 can be mounted to the bristle-less wand 21. The removable detachable cap can provide easy access for the changing of a power supply, such as a non-rechargeable battery.

The removable detachable cap 23 can include a safety screw to ensure a child cannot swallow, choke or be injured from the use of the device. Unlike other devices with loose caps, the integral gum soother can prevent choking in children, while stimulating their gums.

The bristle-less wand 21 can have a charging port 30, which can penetrate the removable detachable cap 23 to allow for easy charging of the power supply. In embodiments, the power supply can be an onboard power supply, which can be a rechargeable battery.

In embodiments, the batteries can be from 2 AAA to 4 AAA DC batteries connected together. In other embodiments, the batteries can be from 1 AA to 2 AA DC batteries or a single 9-volt DC battery.

The charging port 30 can be a USB compatible port, such as a mini USB compatible port. The charging port can be an A/C port, a D/C port or any other style of charging port.

A mouth guard 40 can be connected to the bristle-less wand 21. The mouth guard 40 can extend at a first angle 38. The first angle 38 can range from 40 degrees to 120 degrees from the bristle-less wand 21.

In embodiments, the mouth guard can be made from a harder, thicker silicone rubber material than the bristle-less wand 21.

A flex neck 50 can extend longitudinally from the bristle-less wand 21. The flex neck 50 can be oriented at a second angle 41 from the mouth guard 40. The second angle 41 can range from 40 degrees to 120 degrees.

A hollow membrane-free dual chew tip 60 can be connected longitudinally to the flex neck 50. The hollow membrane-free dual chew tip 60 can be heated or cooled dependent on the user's preference.

In embodiments, the hollow membrane-free dual chew tip 60 can have a larger outer diameter than the flex neck, such as from 10 percent to 25 percent larger. The hollow membrane-free dual chew tip 60 should be sufficiently large in outer diameter to cover gums of a child without being overly large in the child's mouth to prevent chocking or other bodily harm to a child while simultaneously providing comfort to the mouth of the child.

In embodiments, a USB port 402 can be located at an end of the bristle-less wand 21 for receiving audio messages from a source external to the integral gum soother.

Figure 3:
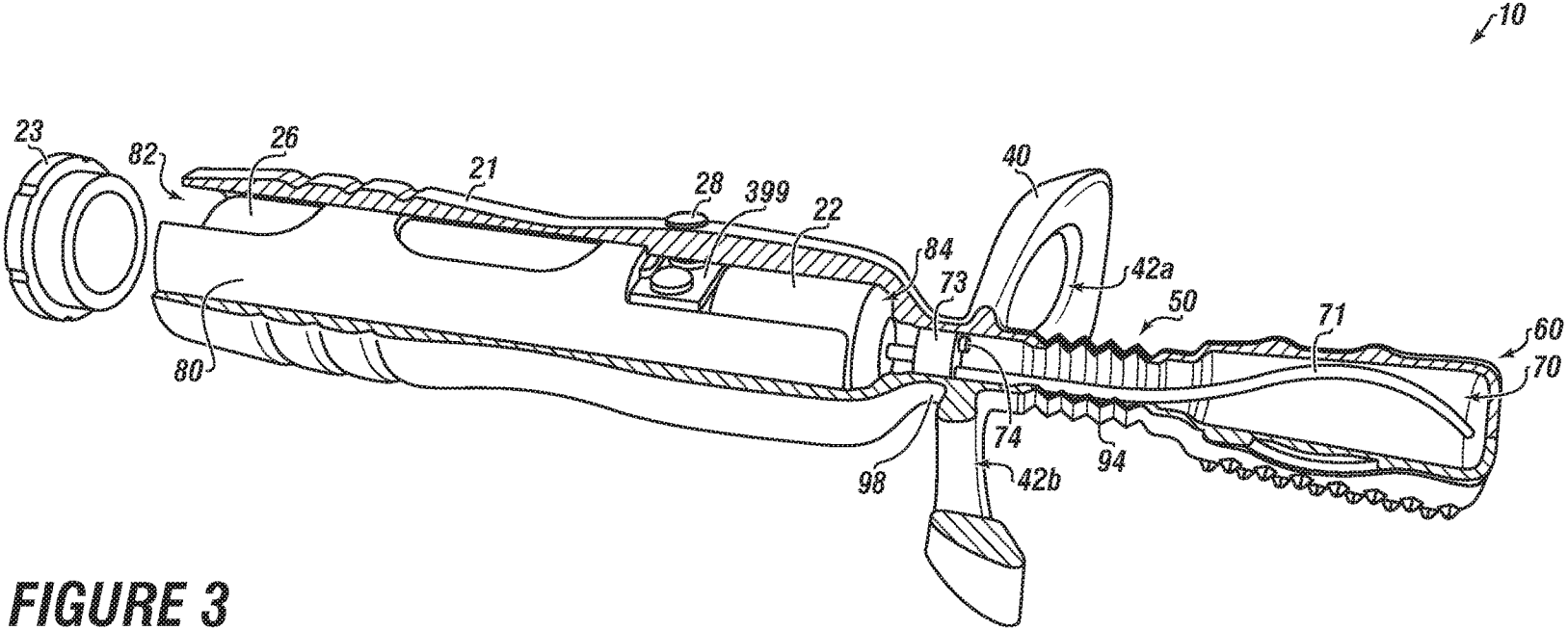
FIG. 3 depicts a partial cut view of the integral gum soother according to one or more embodiments.

A speaker 400 can be internal to the bristle-less wand and connected to a programmable logic circuit, shown in FIG. 3, for playing back audio messages from the external source, which can be spoken words, sounds, music, or the like. For example, the audio messages can someone singing happy birthday, or a dentist saying brush your teeth twice a day.

An on/off recording switch 401 can be connected to the programmable logic circuit enabling actuation and stopping of playback of the audio messages.

Figure 2:
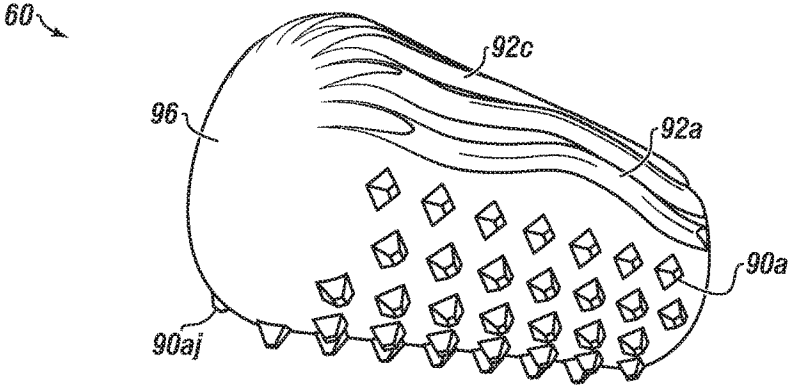
FIG. 2 depicts a hollow membrane-free dual chew tip of the integral gum soother according to one or more embodiments.

FIG. 2 depicts a hollow membrane-free dual chew tip of the integral gum soother according to one or more embodiments.

The hollow membrane-free dual chew tip 60 can have an outer surface 96.

In embodiments, the hollow membrane-free dual chew tip 60 can be tapered. In embodiments, the hollow membrane-free dual chew tip 60 can be cylindrical in shape.

A plurality of facets 90*a*-90*aj* and a plurality of ridges 92*a*-92*c* can be formed on the outer surface 96 of the hollow membrane-free dual chew tip 60.

In embodiments, the plurality of facets 90*a*-90*aj* can extend from the outer surface of the hollow membrane-free dual chew tip 60 from 0.1 mm to 0.3 mm and have a density of facets ranging from 6 facets per $cm^2$ to 12 facets per $cm^2$.

The plurality of facets can be any geometric shape such as diamond shaped, pyramid shaped, round shaped or combinations thereof. The plurality of facets can be curvilinear.

In embodiments, the plurality of facets can be filled and solid to enable a child to apply pressure to the gums for comforting compression.

In embodiments, the plurality of facets can be molded from the same material as the outer surface 96 of the hollow membrane-free dual chew tip 60. In embodiments, the plurality of facets can be made from a rubberized silicon material.

In embodiments, the plurality of ridges 92*a*-92*c* can extend from the outer surface 96 of the hollow membrane-free dual chew tip 60. The plurality of ridges can extend from the outer surface from 0.1 mm to 0.3 mm and have a density ranging from 2 ridges to 6 ridges per centimeter of the outer surface.

In embodiments, the plurality of ridges can be parallel to each other. In other embodiments, the plurality of ridges can be grouped and a first group of parallel ridges can be at a right angle to a second group of parallel ridges.

In embodiments, the plurality of ridges can be curvilinear or wavy.

Each ridge of the plurality of ridges can have a thickness ranging from 0.08 mm to 0.12 mm.

FIG. 3 depicts a partial cut view of the integral gum soother according to one or more embodiments.

The programmable logic circuit 399 can be interior to the bristle-less wand 21 for receiving and storing for playback of the audio messages.

The integral gum soother 10 can have a bristle-less wand 21.

In embodiments, the bristle-less wand 21 can have a length from 7 cm to 10 cm and a diameter ranging from 1.5 cm to 3 cm.

In embodiments, the bristle-less wand 21 can be a molded one piece unit formed from a silicone based plastic incorporating a soft rubber or similar material.

In embodiments, the bristle-less wand 21 can have a wall thickness from about 0.05 mm and 0.20 mm.

In embodiments, the bristle-less wand 21 can have an internal casing 80 contained inside the bristle-less wand 21.

In embodiments, the internal casing 80 can be force fit within the bristle-less wand 21.

The internal casing 80 can have a first chamber 82 and a second chamber 84.

In embodiments, the first chamber 82 can hold a power supply 26 and can be accessed by the removable detachable cap 23.

The power supply 26 can be a rechargeable battery, a non-rechargeable battery, a solar cell, or any known power supply in the industry, and combinations thereof.

The second chamber 84 can contain the on/off switch 28 and a motor 22. The on/off switch can be a pressure switch, which can be light pressure, operable by a child or an elderly person without much ability to apply pressure.

In embodiments, the second chamber 84 can be tapered at one end to contain the motor 22 in a snug fit.

In embodiments, the motor 22 can cycle for a predetermined duration when activated by the on/off switch 28. For example, the motor can operate for 5 minutes then shut off. In other embodiments, the motor can operated until it is powered off.

In embodiments, the motor 22 can be attached to an internal vibrating device 70.

The internal vibrating device 70 can comprise a rotating vibrating arm 71 connected to a rotating device 73.

In embodiments, the rotating device 73 can include an eccentric weight 74 that facilitates in vibrating the bristle-less wand 21. In other embodiments, the rotating vibrating arm 71 can be offset on the rotating device 73 providing the vibrating action needed to soothe the child's gums.

The mouth guard 40 can be connected to the bristle-less wand 21 and can have a plurality of vents 42*a* and 42*b* for rash prevention formed therein to prevent rashes from forming on cheeks of a user.

The mouth guard 40 can also prevent the user from inserting the bristle-less wand too far into their mouth, which could cause to damage the user's throat or choking.

While two vents 42*a* and 42*b* are shown, more vents can be formed in the mouth guard 40. In embodiments, the diameter of each vent can range from a 1 cm diameter to 2 cm diameter.

In embodiments, the mouth guard 40 can have a thickness ranging from 0.50 cm to 1.5 cm and a diameter ranging from 5 cm to 7 cm.

In embodiments, the mouth guard 40 can be molded to conform to lips of a user.

The flex neck 50 can extend longitudinally from the bristle-less wand 21. The flex neck 50 can have at least one elevation 94 to increase the flexible range of the flex neck 50, while also allowing a user to have an area to grip the flex neck 50 with their lips.

In embodiments, the at least one elevation 94 can have a height ranging from 0.1 mm to 0.5 mm from the surface of the flex neck.

In embodiments, the flex neck 50 can bend from 1 degree to 45 degrees, a length from 0.5 cm to 1.5 cm and a diameter from 0.5 cm to 1.5 cm.

In embodiments, the hollow membrane-free dual chew tip 60 can be configured to sustain a reduced temperature from room temperature to at least 20 degrees Fahrenheit if needed.

For example, the entire integral gum soother 10 can be placed in a refrigerator or freezer compartment of a home refrigerator/freezer and left to chill, such as for at least 1 hour. Upon removal from the refrigerator/freezer the temperature of the integral gum soother 10 will have dropped from room temperature of 80 degrees Fahrenheit to 60 degrees Fahrenheit, giving a child a cool wand to chew on, providing a device that reduces inflammation of the gums.

The hollow membrane-free dual chew tip 60 can be connected to the flex neck 50.

In embodiments, the hollow membrane-free dual chew tip 60 can be heated or cooled dependent on the user's preference.

In embodiments, the hollow membrane-free dual chew tip 60 can have a length from 1.5 cm to 2.5 cm and a diameter from 1 cm to 1.5 cm.

The integral gum soother 10 can have a hollow body reducer 98 connecting between the mouth guard 40 and the motor 22. As an example, the hollow body reducer can narrow the outer diameter of the bristle-less wand 21 by 40 percent to 60 percent.

Figure 4:
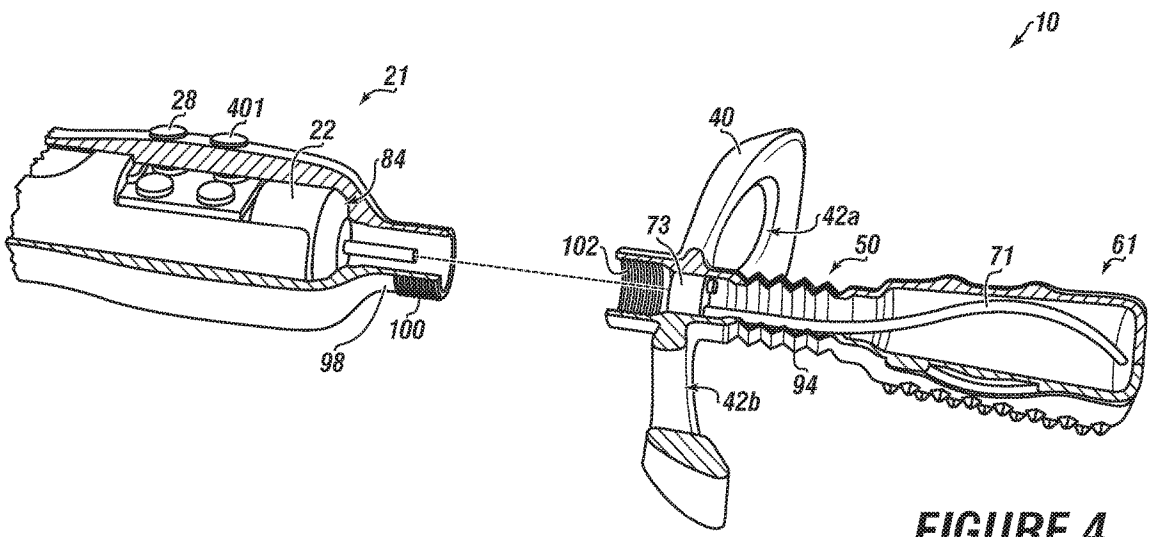
FIG. 4 depicts the integral gum soother with a bristle-less wand detachable from a removable hollow membrane-free dual chew tip according to one or more embodiments.

FIG. 4 depicts the gum soother with a bristle-less wand detachable from a removable hollow membrane-free dual chew tip according to one or more embodiments.

The gum soother 10 with the bristle-less wand 21, the motor 22, and the on/off switch 28 for activating the motor are depicted.

The on/off recording switch 401 can be connected to the programmable logic circuit, of FIG. 3, enabling actuation and stopping of playback of audio messages.

The second chamber 84 can contain the on/off switch 28 and the motor 22.

The hollow body reducer 98 can connect between the mouth guard 40 and the motor 22.

In embodiments, the mouth guard 40 can be connected to the flex neck 50 extending at a first angle from the flex neck 50. The flex neck can longitudinally engage the bristle-less wand 21 and is depicted with at least one elevation 94.

The plurality of vents 42*a* and 42*b* for rash prevention can be formed therein to prevent rashes from forming on cheeks of a user A removable hollow membrane-free dual chew tip 61 can be threadably engageable with the bristle-less wand 21 using first threads 100 installed on the bristle-less wand 21 and second threads 102 installed on the flex neck 50 of the removable hollow membrane free dual chew tip.

In embodiments, the removable hollow membrane-free dual chew tip 61 can be configured to contact and massage the gums and sustain a reduced temperature from room temperature to at least 20 degrees Fahrenheit if needed, and further wherein the removable hollow membrane-free dual chew tip can contain the rotating vibrating arm 71 connected to the rotating device 73.

The following is an example of the use of the gum soother, but is not limited by this description.

Baby Tinsley is teething. Mother Lori or other caregiver can turn on the gum soother using the on/off switch.

Mother Lori then gives Baby Tinsley the gum soother. The Baby Tinsley takes the bristle-less wand and chews on the hollow membrane-free dual chew tip, sometimes putting the hollow membrane-free dual chew tip 60 into the mouth up to the mouth guard.

Baby Tinsley is able to reach the back molars or hard to reach areas for teething because of the flex neck.

The gum soother is comforting to Baby Tinsley because it has a plurality of facets that fit into where the teeth are coming in and simultaneously a plurality of ridges that massage the top gums. The bristle-less wand prevents Baby Tinsley from getting infections. Also, the bristle-less wand prevents gum irritation caused by bristles.

The embodiments include a method of massaging the gums of a user. The method can involve placing the hollow membrane-free dual chew tip proximate to a child's mouth and proximate to a child's hand, activating the on/off switch, and applying motion to the hollow membrane-free dual chew tip.

Figure 5:
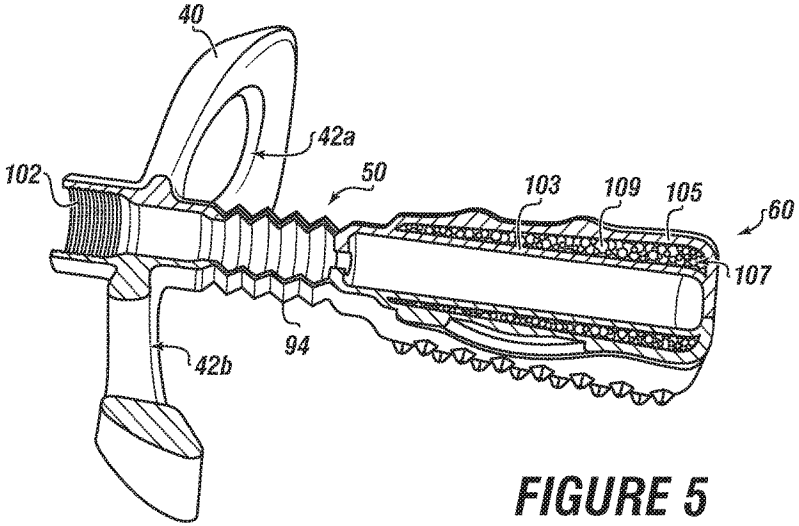
FIG. 5 is a detailed view of a cooling/heating version of the hollow membrane-free dual chew tip holding a temperature controlling material according to one or more embodiments.

FIG. 5 is a detailed view of a cooling/heating version of the chew tip holding a temperature controlling material according to one or more embodiments.

In embodiments, the chew tip 60 can have a flexible first wall 103 and a flexible second wall 105. In embodiments, the flexible second wall can be parallel to and in a spaced apart relationship from the first wall forming a channel 107.

In embodiments, a temperature control material 109 can be located in the channel 107 between the flexible first wall 103 and the flexible second wall 105 for holding a cooler temperature than the walls or a higher temperature than the walls.

The temperature control material 109 can be used for cooling or heating the chew tip. In embodiments, the temperature control material can be a gel or beads.

While these embodiments have been described with emphasis on the embodiments, it should be understood that within the scope of the appended claims, the embodiments might be practiced other than as specifically described herein.

What is claimed is:

1. An integral gum soother comprising:

a. a bristle-less wand comprising:
  i. a motor;
  ii. a power supply connected to the motor;
  iii. a programmable logic circuit interior to the bristle-less wand for receiving and storing playback of audio messages;
  iv. a USB port at an end of the bristle-less wand for receiving the audio messages from a source external to the integral gum soother and conveying the audio messages to the programmable logic circuit;
  v. a speaker internal to the bristle-less wand connected to the programmable logic circuit for playing back the audio messages;
  vi. an on/off recording switch connected to the programmable logic circuit enabling actuation and stopping of playback of the audio messages;
  vii. an on/off switch connected between the power supply and the motor for activating the motor; and
  viii. an internal vibrating device connected to the motor;

b. a mouth guard connected to the bristle-less wand extending at a first angle from 40 degrees to 120 degrees from the bristle-less wand;

c. a flex neck connected longitudinally to the bristle-less wand extending at a second angle from 40 degrees to 120 degrees from the mouth guard; and d. a hollow membrane-free dual chew tip connected to the flex neck, wherein the hollow membrane free dual chew tip is configured to contact and massage the gums and sustain a reduced temperature from room temperature to at least 20 degrees Fahrenheit, if needed, and further wherein the hollow membrane-free dual chew tip contains a rotating vibrating arm.

2. The integral gum soother of claim 1, comprising an internal casing contained inside the bristle-less wand having a first chamber containing the power supply and a second chamber containing the on/off switch and the motor.

3. The integral gum soother of claim 1, wherein the power supply is at least one of: a non-rechargeable battery, a solar cell, and a rechargeable battery.

4. The integral gum soother of claim 1, comprising a charging port engaging the USB port connected to the power supply for recharging the power supply.

5. The integral gum soother of claim 1, wherein the bristle-less wand is a molded one piece unit.

6. The integral gum soother of claim 1, wherein the bristle-less wand is a silicone based plastic, a soft rubber, a rubberized silicon material, and combinations thereof.

7. The integral gum soother of claim 1, wherein the internal vibrating device comprises the rotating vibrating arm connected to a rotating device that further engages the motor.

8. The integral gum soother of claim 1, comprising a switch locator on an outer surface of the bristle-less wand for easily locating of the on/off switch mounted within the bristle-less wand.

9. The integral gum soother of claim 1, wherein the hollow membrane-free dual chew tip comprises a plurality of facets and a plurality of ridges mounted on an outer surface of the hollow membrane-free dual chew tip.

10. An integral gum soother comprising:

a. a bristle-less wand comprising:
  i. a motor;
  ii. a power supply connected to the motor;
  iii. an on/off switch connected between the power supply and the motor for activating the motor; and
  iv. an internal vibrating device connected to the motor;

b. a mouth guard connected to the bristle-less wand extending at a first angle from 40 degrees to 120 degrees from the bristle-less wand;

c. a flex neck connected longitudinally to the bristle-less wand extending at a second angle from 40 degrees to 120 degrees from the mouth guard; and d. a chew tip comprising:
  i. a flexible first wall;
  ii. a flexible second wall parallel to and in a spaced apart relationship from the flexible first wall; and
  iii. a temperature control material located in the channel between the flexible first wall and the flexible second wall for holding a different temperature than the flexible first wall and the flexible second wall.

11. The integral gum soother of claim 10, wherein the temperature control material is a gel or beads.

12. A gum soother comprising:

a. a bristle-less wand comprising:
  i. a motor;
  ii. a power supply connected to the motor;

iii. an on/off switch connected between the power supply and the motor for activating the motor; and iv. an internal vibrating device connected to the motor;

b. a mouth guard connected to the bristle-less wand extending at a first angle from 40 degrees to 120 degrees from the bristle-less wand;

c. a flex neck connected longitudinally to the bristle-less wand extending at a second angle from 40 degrees to 120 degrees from the mouth guard; and d. a removable hollow membrane-free dual chew tip threadably engaging the bristle-less wand using first threads installed on the bristle-less wand and second threads installed on the flexible neck, wherein the removable hollow membrane-free dual chew tip is configured to contact and massage the gums and sustain a reduced temperature from room temperature to at least 20 degrees Fahrenheit, if needed, and further wherein the removable hollow membrane-free dual chew tip contains a rotating vibrating arm.

13. The gum soother of claim 12, comprising a plurality of vents for rash prevention formed therein to prevent rashes from forming on cheeks of a user.

14. The gum soother of claim 12, comprising a hollow body reducer connecting between the mouth guard and the motor.

* * * * *